US005184100A

United States Patent [19]

Oyama et al.

[11] Patent Number: 5,184,100

[45] Date of Patent: Feb. 2, 1993

[54] CIRCUIT BREAKER

[75] Inventors: Jun Oyama; Naoshi Uchida, both of Kanagawa, Japan

[73] Assignee: Fuji Electric Co., Ltd., Kanagawa, Japan

[21] Appl. No.: 691,425

[22] Filed: Apr. 25, 1991

[30] Foreign Application Priority Data

| | | | |
|---|---|---|---|
| Apr. 26, 1990 | [JP] | Japan | 2-111159 |
| Jul. 19, 1990 | [JP] | Japan | 2-191682 |
| Nov. 22, 1990 | [JP] | Japan | 2-318868 |

[51] Int. Cl.[5] ..... H01H 75/00

[52] U.S. Cl. ..... 335/16; 335/147; 335/195; 335/132; 335/202

[58] Field of Search ..... 335/16, 147, 195, 202, 335/132

[56] References Cited

U.S. PATENT DOCUMENTS

| | | | |
|---|---|---|---|
| 4,539,538 | 9/1985 | Flick et al. | 335/16 |
| 4,654,491 | 3/1987 | Maier et al. | 335/16 |
| 4,970,481 | 11/1990 | Arnold et al. | 335/6 |
| 5,027,096 | 6/1991 | White et al. | 335/202 |

FOREIGN PATENT DOCUMENTS

| | | |
|---|---|---|
| 1523191 | 9/1969 | Fed. Rep. of Germany . |
| 800504 | 8/1958 | United Kingdom . |

*Primary Examiner*—Lincoln Donovan
*Attorney, Agent, or Firm*—Finnegan, Henderson, Farabow, Garrett and Dunner

[57] ABSTRACT

A circuit breaker having at least one phase or pole including a first movable arm having a first contact and a second movable arm having a second contact. The first arm is driven by a switching gear. The second arm is disposed opposite to the first movable arm such that the second contact contacts the first contact when a normal current flows. The first arm exerts an electromagnetic repulsive force in such a direction that the first and second arms repel each other to open the first second contacts when a current exceeds a predetermined value. The second arm is pivotally supported by a support angle fixed on a housing and is electrically connected via a flexible lead with a terminal also fixed on the housing. The support angle and the terminal are fitted to an insulator such that the support angles, the terminal and insulator are assembled in a unitary construction.

7 Claims, 10 Drawing Sheets

3 TERMINAL

14 INSULATOR

CIRCUIT BREAKER

BACKGROUND OF THE INVENTION

1. Field of the Invention

The present invention relates to circuit breakers such as a molded-case circuit breaker or an earth leakage breaker, and more particularly to a circuit breaker in which contacts repel each other in order to open when a large current such as a short circuit is to be interrupted.

2. Description of the Related Art

FIG. 17 is a longitudinal cross-sectional view of one of three poles of a conventional circuit breaker. FIG. 18(A) is a top view of a second movable arm shown in FIG. 17 and FIG. 18(B) a side view thereof.

Referring to FIG. 17, a first movable arm 5 has a movable contact 5*a* and a second movable arm 4 has a fixed contact 4*a*. A housing 1 and a cover 2 are molded from resin. Within the housing 1, in addition to the first and second movable arms 4 and 5, are housed terminals 3 on the line side, arc suppressing chamber 6, switching gear 7, overcurrent tripping gear 8, and terminals 9 on the load side.

As shown in the figures, the second movable arm 4 is a generally V-shaped conductor and is rotatably supported at its bottom portion by means of a shaft 10 disposed on a support angle 11. The arm 4 is biased against the first movable arm 5 by a return spring 12 of a torsion coil type mounted on the shaft 10. The second movable arm 4 is connected to the terminal 3 via a lead 13 connected to a lower end of the arm 4.

The support angle 11 is made of pressed-steel. As shown in FIGS. 18(A) and 18(B), two opposing side walls 11*b* rise from a bottom 11*a* so that the overall shape of the angle 11 is a bifurcation. A stopper 11*c* rises from the bottom 11*a* to stop the second movable arm 4, which tends to rotate clockwise due to the urging force of the return spring 12. A U-shaped insulator 14 is inserted into the support angle 11 from right to left as shown in FIG. 18(B) so as to electrically isolate the support angle 11 from the lead 13. Then, as shown in FIG. 17, the insulator 14 and the support angle 11 are secured to the housing 1 by means of a bolt 15 inserted into a hole (not shown) in the bottom 11*a* of support angle 11. The terminal 3 is secured to the housing 1 by means of a bolt 17 inserted into a hole 16 as shown in FIG. 17.

FIG. 17 shows the circuit breaker when the contacts are closed. A current flows from the terminal 3 through lead 13, second movable arm 4, first movable contact 5*a*, lead 18, a heater and a lead 8*b* of overcurrent tripping gear 8 to the terminal 9. When a large current such as a short-circuit current flows through the circuit breaker, an electromagnetic repulsive force is developed between the arms 4 and 5 due to the fact that the current flowing in the arm 4 flows in a direction opposite to that in the arm 5, as depicted by arrows in FIG. 17.

The repulsive force drives the second arm 4 into counterclockwise rotation against the return spring 12 prior to contact-opening operation of the first arm 5. Then, the arc voltage across the contacts 4*a* and 5*a* is increased, and the switching gear 7, actuated by the overcurrent tripping gear 8, drives the first movable arm 5 to an open position to quickly perform a current-limiting circuit-breaking operation.

When assembling the aforementioned circuit breaker, the terminal 3 and the second movable arm 4 assembled together with the support angle 11 are placed in the housing 1 with the lead 13 connected between them. Since the lead 13 is a flexible wire having its two ends brazed into the arm 4 and terminal 3, respectively, the whole assembly is quite difficult to handle. In order to fix the assembly to the bottom of the housing 1 as shown in FIG. 17, it is required that the terminal 3 and the second movable arm 4 at each end of the lead 13, be positioned separately within the housing 1. Usually, repulsion type circuit breakers have deep housings as compared to non-repulsion types and it is therefore, time consuming to position the terminal and arm in such a deep housing.

In FIG. 17, the housing 1 is provided with a space 19 for each pole for accommodating a later described current-limiting resistor. The space 19 is closed by a rear cover 20. The rear cover 20 is glued to housing 1 by means of adhesive 21 as shown in FIG. 19, so that electrically conductive arc gas, typically produced when a large current such as a short-circuit current is interrupted, leaks between electrical conductors of each of three phases, or leaks from conductors inside the breaker to external conductors.

The adhesive 21 is a twin pack adhesive which is charged into a clearance between the housing 1 and the rear cover 20. This type of adhesive requires a long cure time. Furthermore, the amount and place of application of the adhesive tends to vary from worker to worker, resulting in inconsistent performance.

SUMMARY OF THE INVENTION

An object of the present invention is to provide a circuit breaker in which the terminal and the second movable arm connected by means of a lead are assembled in a unitary construction to facilitate easy placement of the terminal and second movable arm into the housing.

Another object of the present invention is a circuit breaker wherein an insulator is used which engages both the support angle and the terminal to provide a unitary construction therebetween.

A further object of the present invention is to eliminate the necessity of adhering the rear cover closely with the housing in an air tight fashion through adhesive.

Yet another object of the present invention is a circuit breaker wherein an insulating cover is provided between the rear cover and a portion of the terminal close to the support angle or wherein a plate-like packing made of a resilient material may be inserted between the housing and the rear cover.

A circuit breaker comprising a housing a terminal disposed in the housing, a first movable arm disposed in the housing, including a first contact, a support member disposed in the housing, a second movable arm pivotally supported by the support member and being electrically connected to the terminal by a flexible lead, the second movable arm including a second contact and being disposed opposite the first movable arm so that the second contact contacts the first contact when a normal current flows, wherein the first movable arm exerts an electromagnetic repulsive force on the second arm in a direction where the first and second movable arms repel each other to open the first and second contacts when a current exceeding a predetermined value flows, and an insulating member fitted with the support member and the terminal to form a unitary construction therebetween.

It is to be understood that both this general description and the following detailed description are exemplary and explanatory only and are not restrictive of the invention as claimed.

BRIEF DESCRIPTION OF THE DRAWINGS

The accompanying drawings, which are incorporated in and constitute a part of the specification illustrate the embodiments of the invention, and together with the description, serve to explain the objects, advantages and principles of the invention.

DETAILED DESCRIPTION OF THE PREFERRED EMBODIMENTS

Figure 1:
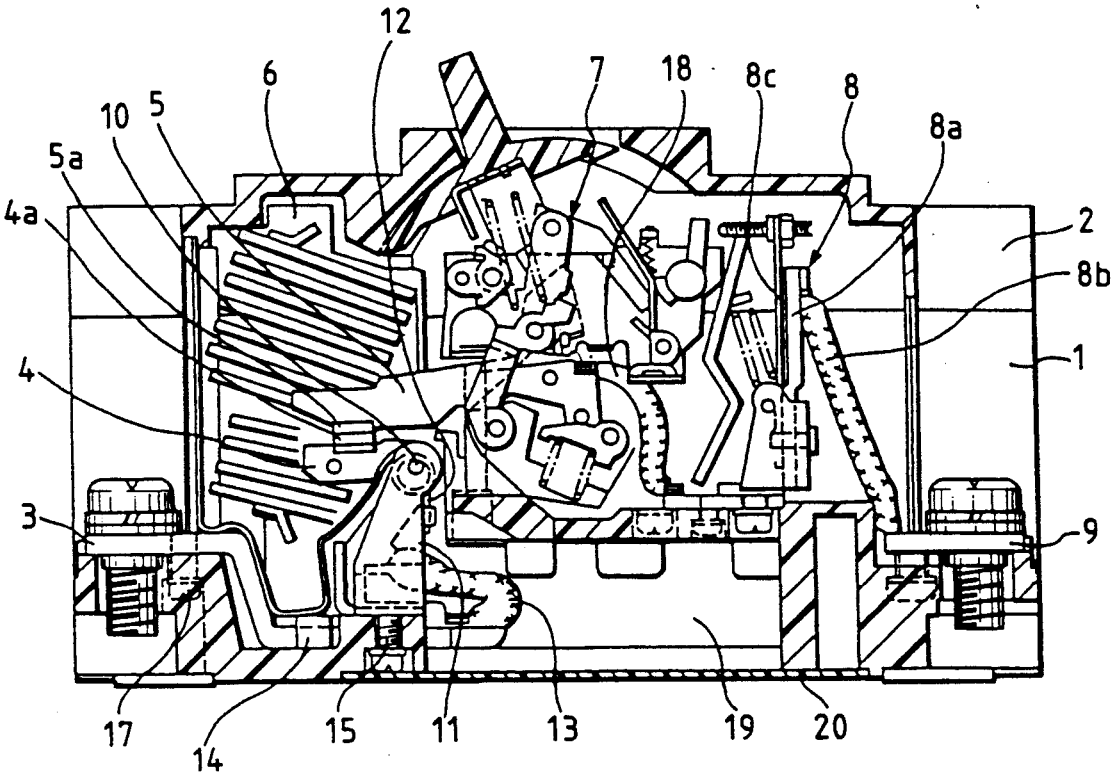
FIG. 1 is a longitudinal cross-sectional view of a first embodiment of a circuit breaker according to the present invention.

The support angle and the terminal are assembled in a unitary construction by an insulator that engages both the support angle and the terminal. This allows the terminal and the support angle to be incorporated as a unit any component into the housing, so that positioning of the terminal and the support angle is readily performed.

Normally, an arc gas starts from conducting parts near the rear cover and leaks between the rear cover and the housing to the adjacent phases or ground. Thus, the insulating cover covers the terminal close to the support angle for isolating the rear cover to cut an electrical leakage route for increased voltage-sustaining capability.

The electrical leakage route can also be cut by shutting off the leakage of the arc gas into the adjacent phases or to the external areas. A resilient plate-like packing inserted between the housing and the rear cover blocks the arc gas tending to move between phases or to the external areas.

Embodiments of the invention will now be described with reference to the drawings. Elements similar to those in the prior art circuit breaker have been given the same reference numerals and the detailed description thereof have been omitted.

FIGS. 1–6 show a first embodiment in which the support angle for a second movable arm and the terminal are assembled in a unitary construction by means of an insulator. In FIGS. 3–6, the support angle 11 is substantially the same as in the prior art breaker. The support angle 11 is made of pressed-steel. Two opposed side walls 11*b* rise from the bottom 11*a* and a stopper 11*c* rises from the front side of the bottom 11*a*. A return spring 12 is clamped at one end by a hook 11*d*. A shaft 10 extends through a bearing hole 22.

The terminal 3 has a substantially L-shaped angle 3*a* substantially the same as that the prior art breaker and has an extension 3*b* that extends horizontally to the support angle 11. Obliquely at the tip of the extension is provided a vertical projection (strap) 3*c* to which the lead 13 is connected. The extension 3*b* is formed with an elongated hole 23 therein and cutouts 24 and 25 at the junction of the angle 3*a* and the extension 3*b*. The insulator 14 molded from resin engages both the support angle 11 and the terminal 3 so that the terminal and the support angle are integral. The insulator 14 has a flat plate 14*a* which engages the bottom of the support angle 11 when assembled. Above the flat plate 14*a* extends another flat plate 14*b* so that the flat plate 14*a* and 14*b* form a groove 26 that opens to the left of the insulator 14. The insulator 14 has another flat plate 14*c* that extends below the plate 14*a* such that a groove 27 is formed between plates 14*a* and 14*c*.

The flat plate 14*a* includes a window-like cutout 28 that extends from the rear end of the plate 14*a*. Generally J-shaped vertical side walls 14*d* rise from each side of the flat plate 14*b*. The flat plate 14*b* has hooks 14*e* at its free end. The flat plate 14*c* has a hook 14*f* at its free end and the flat plate 14*a* has a hook 14*g* which opposes hook 14*f*.

Figure 2A:
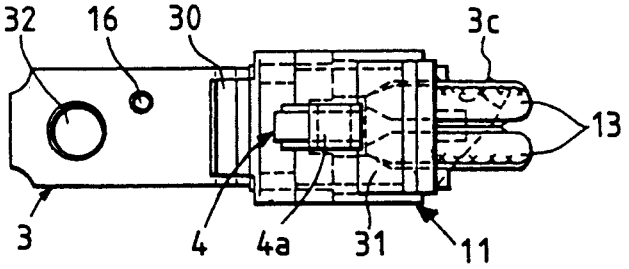
FIG. 2(A) is a top view of a second movable arm shown in FIG. 1.
Figure 2B:
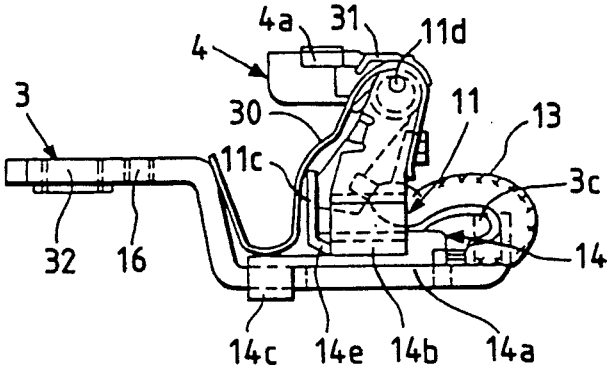
FIG. 2(B) is a side view of the movable arm shown in FIG. 1.

The aforementioned respective members of the second movable arm are assembled into a unitary construction as shown in FIGS. 1(A) and 2(B). The whole assembly is installed into the housing 1 of the circuit breaker.

A pair of leads 13 are brazed at one end to the two sides of the second movable arm 4. The arm 4 is sandwiched by the two leads and at its other end by the two sides of the protrusion 3c of the terminal 3. A return spring 12 made up of a twin torsion-spring is mounted to the support angle 11 by means of a shaft 10 that extends through the springs and is crimped at two ends thereof. The two ends 12a of the return spring engage the hooks 11d of the support angle 11. The second movable arm 4 receives a clockwise rotational force due to a middle portion 12b of the return spring and rotates to abut the stopper 11c.

Figure 3:
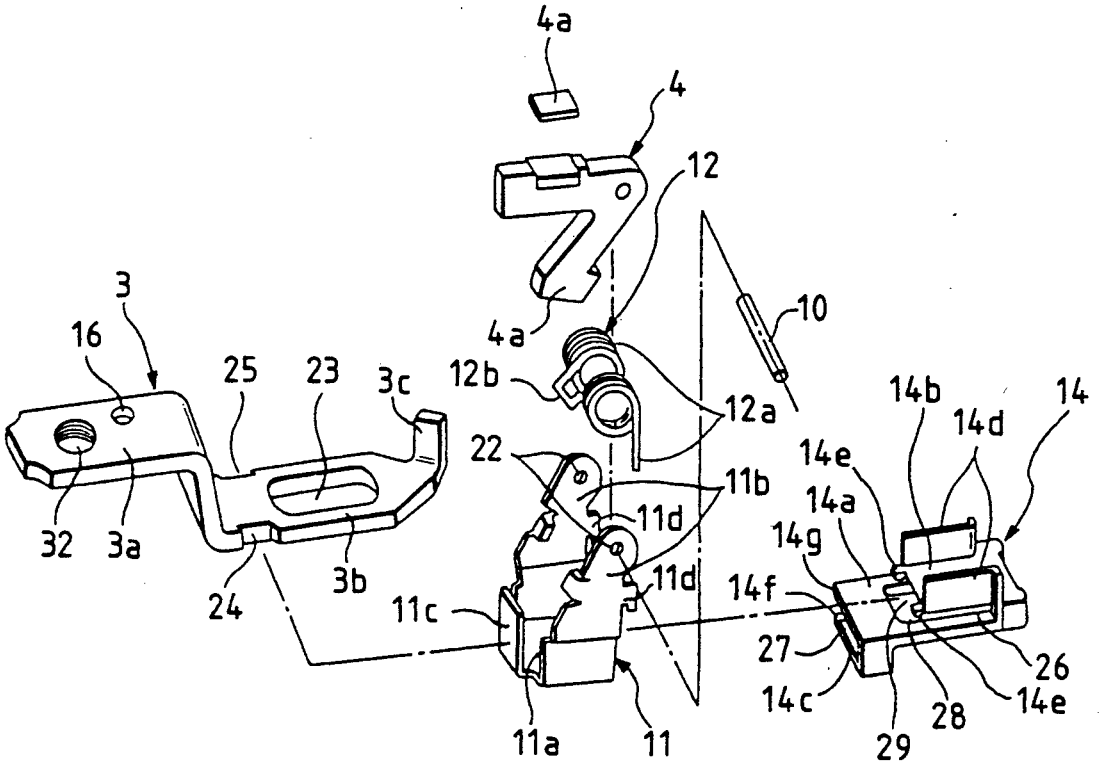
FIG. 3 is an exploded perspective view of FIG. 2.
Figure 4A:
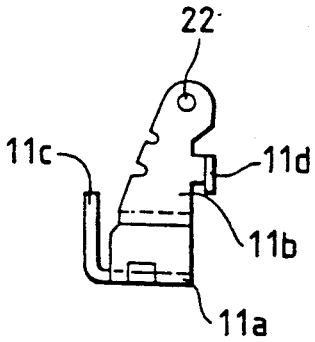
FIG. 4(A) is a side view of the support shown in FIG. 2.
Figure 4B:
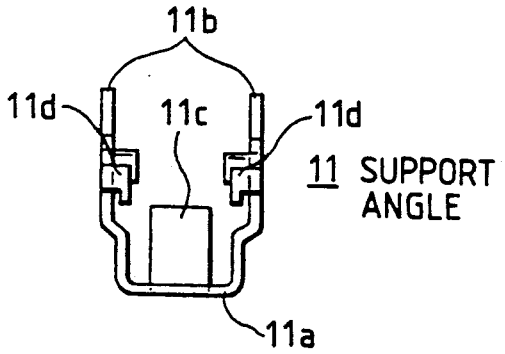
FIG. 4(B) is a rear view of the support angle shown in FIG. 2.
Figure 5A:
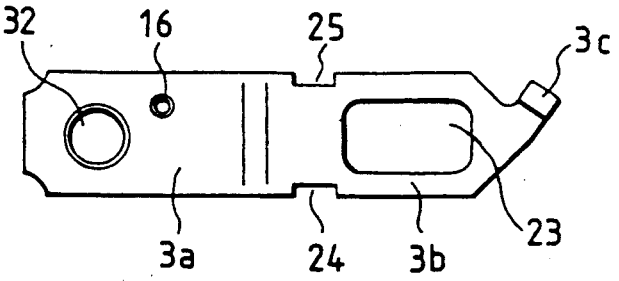
FIG. 5(A) is a top view of the terminal shown in FIG. 2.
Figure 5B:
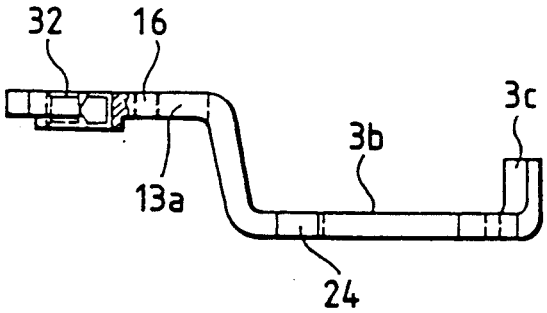
FIG. 5(B) is a side view of the terminal shown in FIG. 2.
Figure 6A:
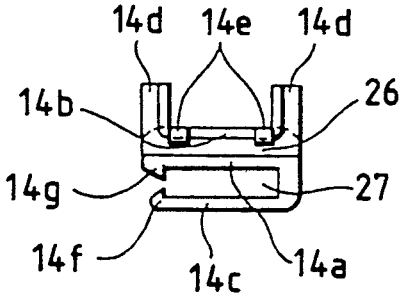
FIG. 6(A) is a plan view of the insulator shown in FIG. 2.
Figure 6B:
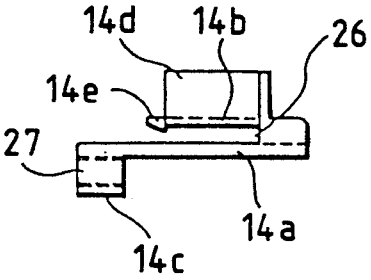
FIG. 6(B) is a side view of the insulator shown in FIG. 2.

The bottom 11a of the support angle 11 is pressed into the groove 26 of the insulator 14 which causes the flat plate 14b to resiliently deform. When the bottom 11a has been completely inserted into the groove 26, the flat plate 14b regains its original position so that the hooks 14e engage the front end of the bottom 11a. The stopper 11c is received by a recess 29 formed between the hooks 14e as shown in FIG. 3. Likewise, the terminal 3 is inserted at the cutouts 24, 25 into the groove 27, so that cutout 24 engages the folded portion of the plate 14c and cutout 25 engages the hooks 14f and 14g. In this manner, the support angle 11, terminal 3, and second movable arm 4 are integrally constructed by means of the insulator 14 that engages both the terminal and the support angle.

Additionally, a flexible insulating sheet 30, shown in FIGS. 2(A) and 2(B) covers the top and the front of support angle 11. The rear of insulating sheet 30 is hooked on the hook 11d at the back of support angle 11 through a square hole not shown. The middle portion of the sheet 30 is depressed by an insulating arm cover 31 assembled onto the second movable arm 4.

FIG. 1 shows a circuit breaker in which the unitary construction of the support angle 11 and the terminal 3 is incorporated. The terminal 3 is secured to the housing 1 by means of a bolt 17 screwed into a threaded hole 16, shown in FIGS. 2(A) and 2(B), from the bottom side of housing 1. The support angle 11 is secured to the housing 1 by means of a bolt inserted from the bottom side of housing 1 and screwed into a threaded hole in the support angle 11 through the window 23 of the terminal 3 (FIG. 3) and the cutout 28 (FIG. 3). The terminal 3 is formed with a threaded hole 32 into which a terminal screw is screwed. The overcurrent tripping gear 8, shown in FIG. 1, is of the type where a bimetal 8c is indirectly heated by a heater 8a.

By the aforementioned construction, the support angle 11 and the terminal 3 are assembled as a unitary construction where a mutual positional relationship between the two parts remains fixed and consistent from one assembly to another. Thus, the unitary construction allows a quick positioning of the unit in the housing and facilitates the subsequent assembly operation.

Figure 7:
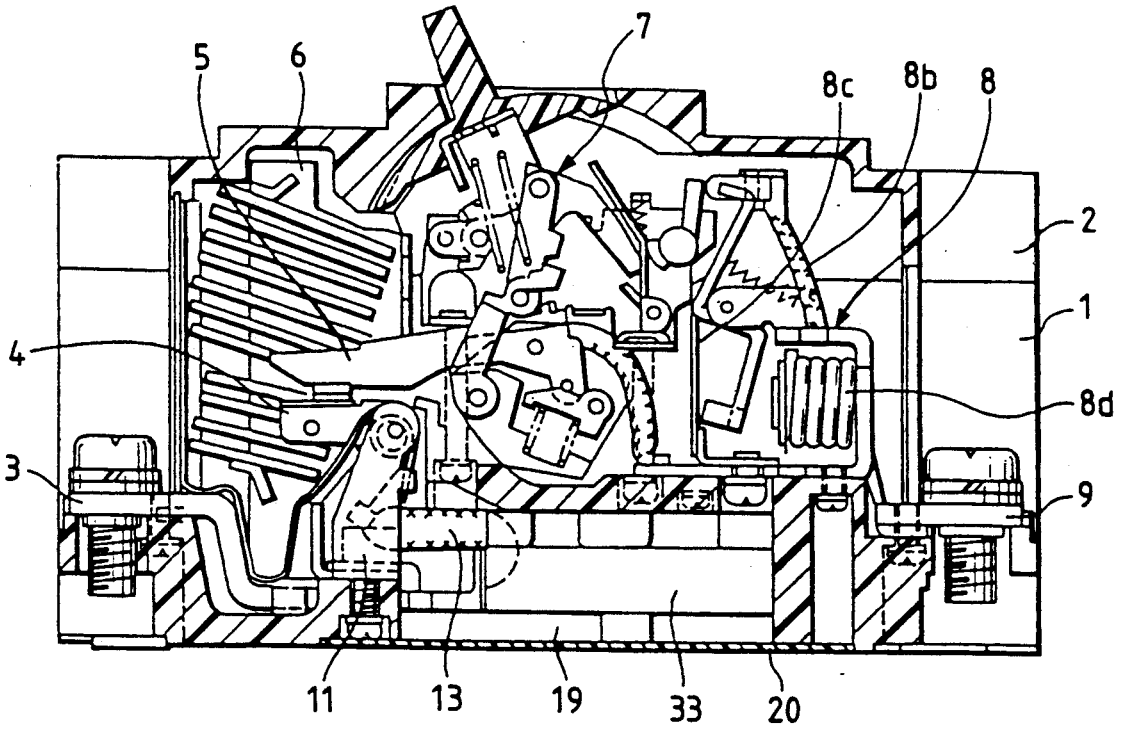
FIG. 7 is a longitudinal cross-sectional view of a second embodiment of a circuit breaker according to the present invention.
Figure 8A:
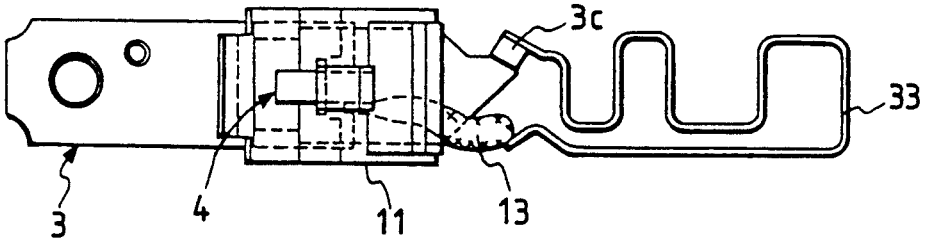
FIG. 8(A) is a top view of the second movable arm shown in FIG. 7A.
Figure 8B:
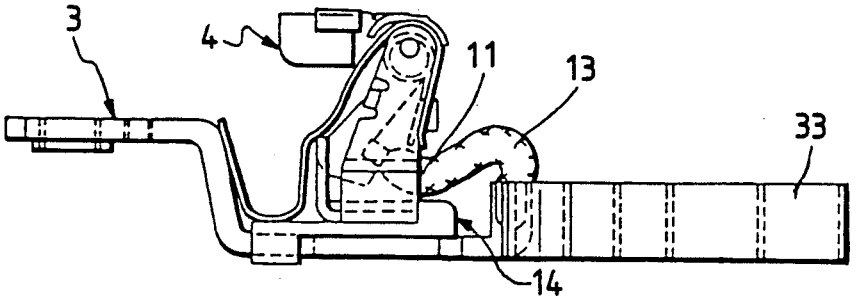
FIG. 8(B) is a side view of FIG. 8(A)
Figure 9:
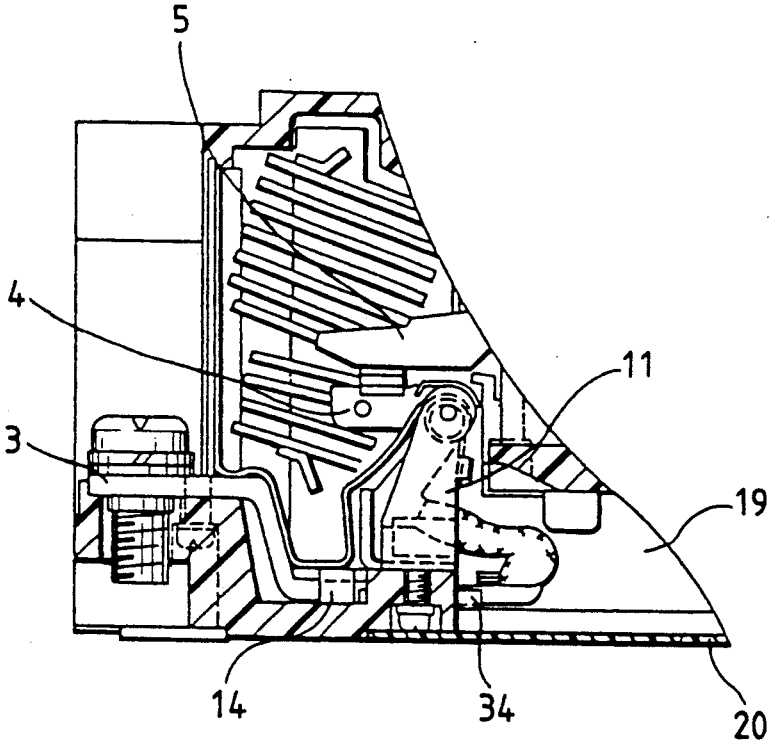
FIG. 9 is a longitudinal cross-sectional view of a third embodiment of a circuit breaker according to the invention.
Figure 10:
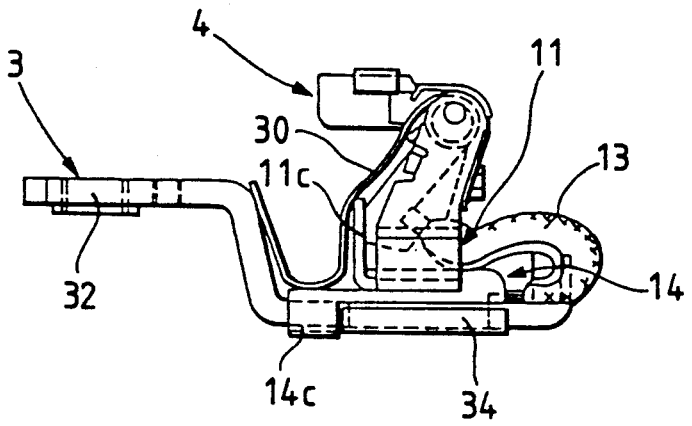
FIG. 10 is a side view of the second movable arm shown in FIG. 1.
Figure 11:
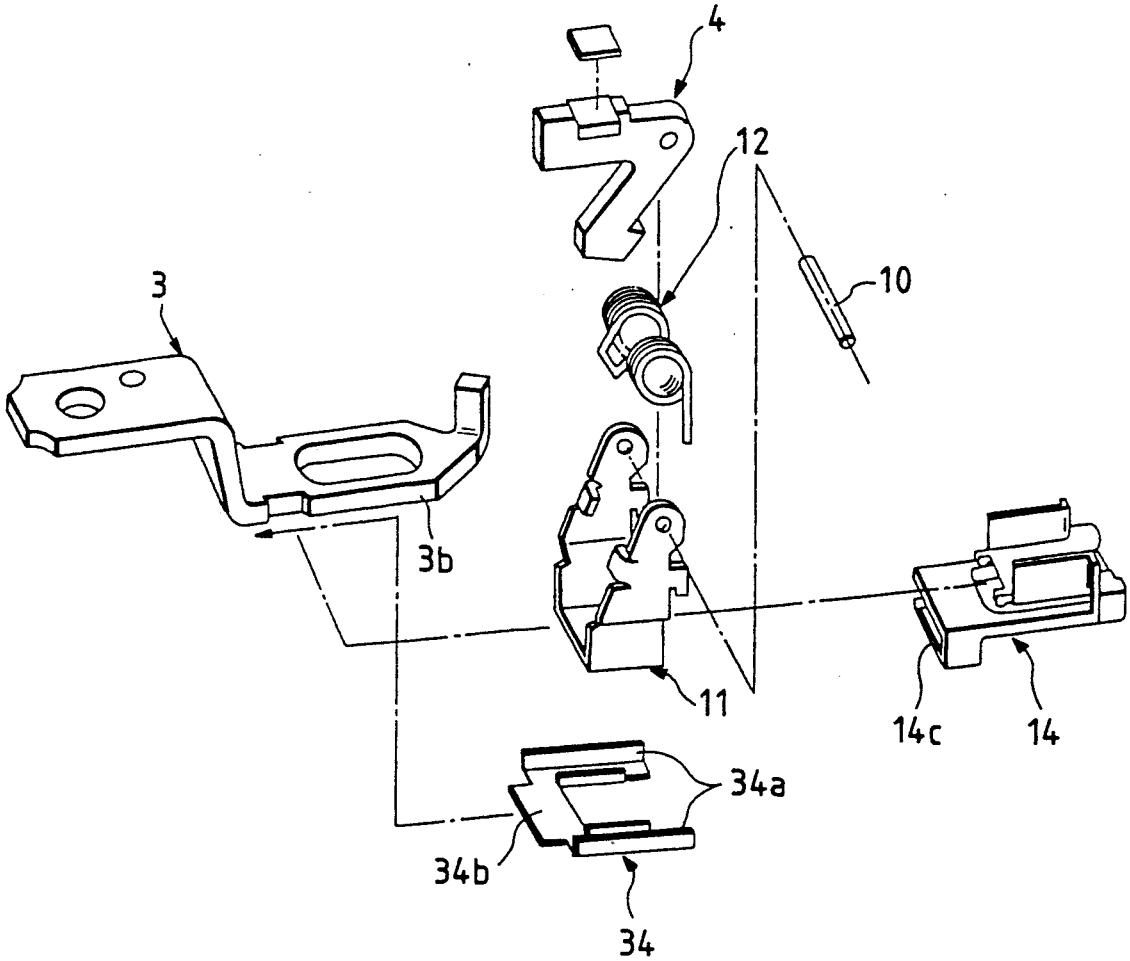
FIG. 11 is an exploded view of FIG. 10.
Figure 12A:
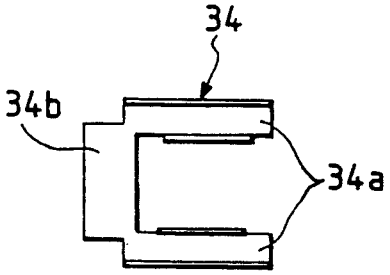
FIG. 12(A) is a top view of the insulating cover shown in FIG. 9.
Figure 12B:
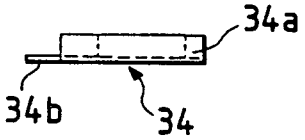
FIG. 12(B) is a side view of the insulating cover shown in FIG. 9.

FIGS. 7, 8(A) and 8(B) show a second embodiment in which a current limiting resistor 33 is inserted between the terminal 3 and the second movable arm 4.

As shown in FIGS. 8(A) and 8(B), the lead 13 is connected at one end to the second arm 4 and at the other end to the current limiting resistor 33. The remaining end of the current limiting resistor 33 is connected to the projection 3c of the terminal 3. The current limiting resistor 33 is located within the space 19 below the first movable arm 5 which is closed by a rear cover 20 adhered to the rear side of the housing 1. Overcurrent tripping gear 8 is of the type that generates a Joule's heat flow through the bimetal 8c as shown in FIG. 7. The overcurrent flows from a lead 8b through a trip coil 8d to the terminal 9. The remaining part of the second embodiment is the same as that of the first embodiment and the description thereof is omitted.

FIGS. 9-12 illustrate a third embodiment of the invention in which an insulating cover is attached to the terminal, close to the support angle.

A U-shaped insulating cover 34 is molded from resin and attached to the terminal 3 close to the support angle 11. Opposed arms 34a of the U-shaped insulating cover 34 are fitted to the two sides of extension 3b. The bottom part 34b of insulating cover 34 is inserted between the flat plate 14c of the insulator 14 and the terminal 3. Attaching the insulating cover 34 to the terminal 3 isolates the terminal 3 from the rear cover 20 to reinforce the insulation effect. Thus, the insulating cover eliminates the need for providing an adhesive between the rear cover 20 and the housing 1 for sealing purposes. Instead, the rear cover 20 can be simply fixed, for example, by bolting or another conventional engagement.

Although the third embodiment has been described with insulating cover 34 being a separate part, the insulating cover 34 can be made integral with the insulator 14.

Figure 14:
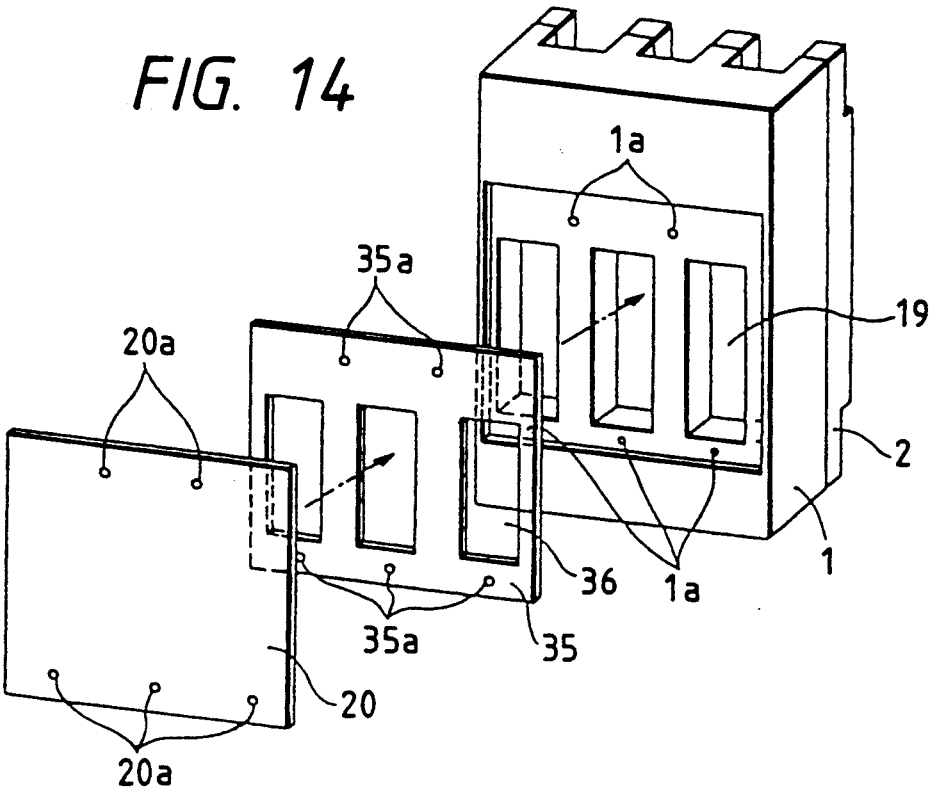
FIG. 14 is an exploded view illustrating the insertion of the plate-like packing between the housing and rear cover shown in FIG. 13.

FIG. 14 illustrates another embodiment of the invention wherein a plate-like packing 35 is inserted between the rear cover 20 and the housing 1.

Figure 13:
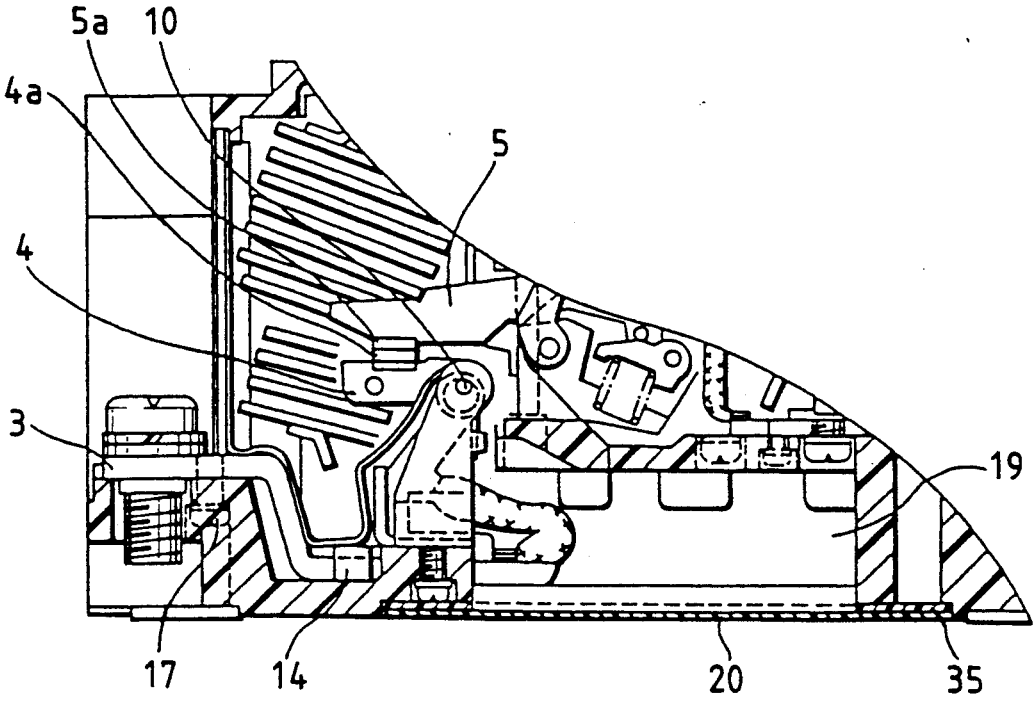
FIG. 13 is a longitudinal cross-sectional view of a fourth embodiment of a circuit breaker according to the present invention.

Referring to FIG. 14, the plate-like packing 35 is made of an insulating rubber material and is of the same shape as the rear cover 20. The packing 35 is formed with windows 36 therein in alignment with the opening of the space 19 of respective phases. The packing 35 is sandwiched between the housing 1 and the rear cover 20 and is fixed by bolts (not shown) screwed into threaded holes 1a through holes 20a of the rear cover 20 and holes 35a of the packing, so that the rear cover 20 is hermetically attached as shown in FIG. 13. Although not shown, a faucet is defined on the rear cover 20 opposing to the housing 1 so as to fit to the opening of the space 19.

The construction in which the packing 35 is inserted between the housing 1 and the rear cover 20 so as to prevent a gap therebetween, allows the respective phases to be independent of each other so that the leakage routes for the arc gas to either leak between the phases or to ground are eliminated to improve the insulating effect. The third embodiment where the insulating cover 34 is provided for the respective phases, requires an increased number of parts and requires that the insulating cover 34 be individually positioned on the terminals 3. The fourth embodiment is advantageous in that only one additional part is required and the assembly operation thereof is rather simple.

Figure 15:
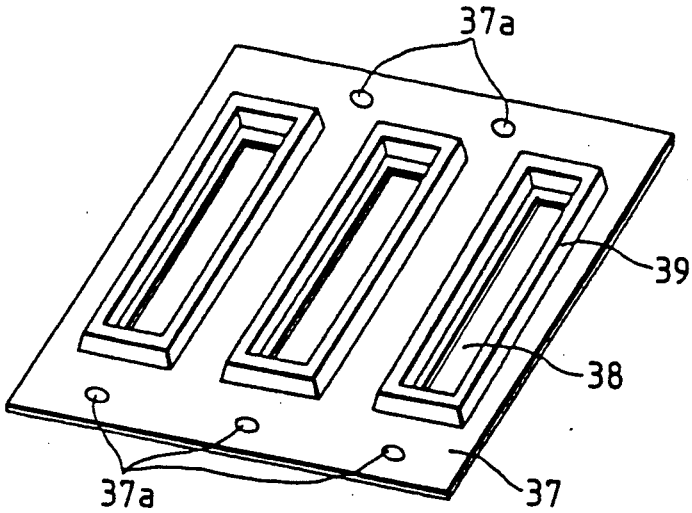
FIG. 15 is a perspective view of the plate-like packing of a fifth embodiment of the present invention.
Figure 16A:
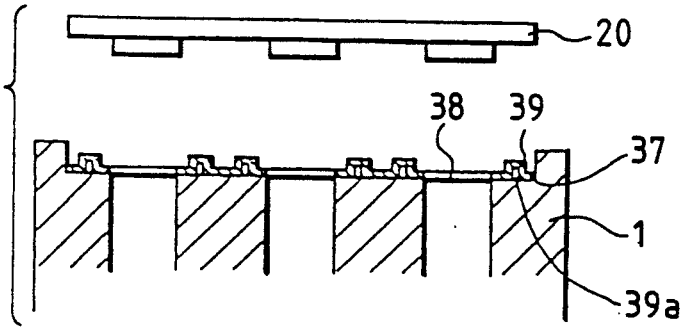
FIG. 16(A) is a lateral cross-sectional view illustrating the insertion of the plate-like packing between the housing and the rear cover.
Figure 16B:
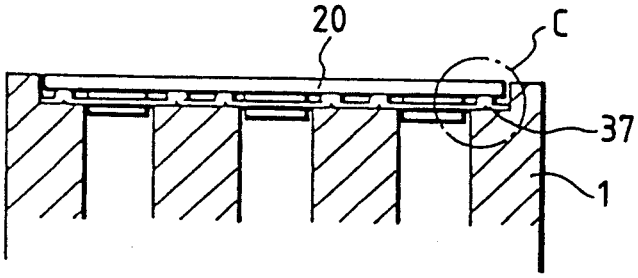
FIG. 16(B) is a lateral cross-sectional view illustrating the packing inserted between the housing and the rear cover.

FIG. 15 shows another plate-like packing 37 inserted between the rear cover 20 and the housing 1. FIG. 16(A) illustrates the packing before the rear cover 20 is mounted to the housing 1. FIG. 16(B) illustrates the packing after the rear cover 20 is mounted to the housing 1.

Figure 16C:
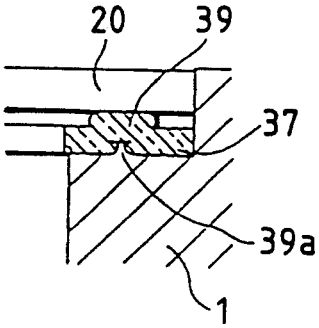
FIG. 16(C) is an expanded view of an area labeled C shown in FIG. 16(B)
Figure 17:
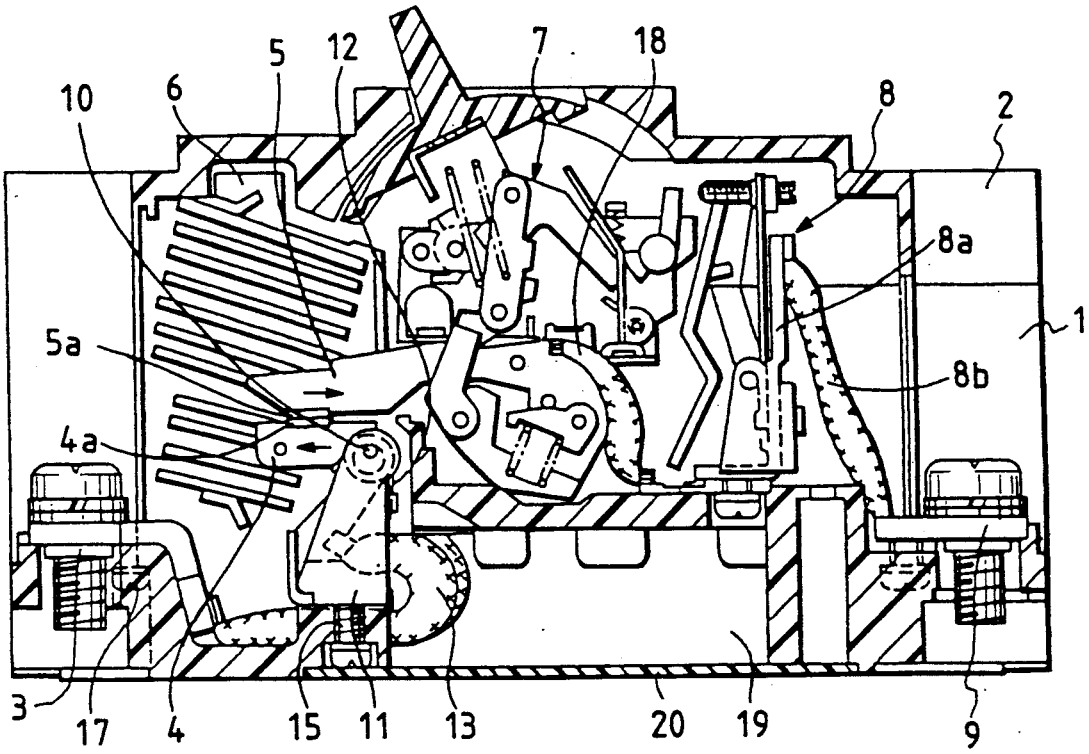
FIG. 17 PRIOR ART
FIG. 17 is a longitudinal cross-sectional view of a conventional circuit breaker.
Figure 18A:
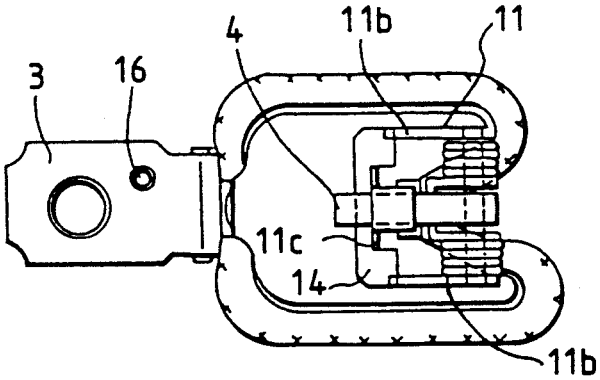
FIG. 18(A) PRIOR ART
FIG. 18(A) is a top view of a second movable arm shown in FIG. 17.
Figure 18B:
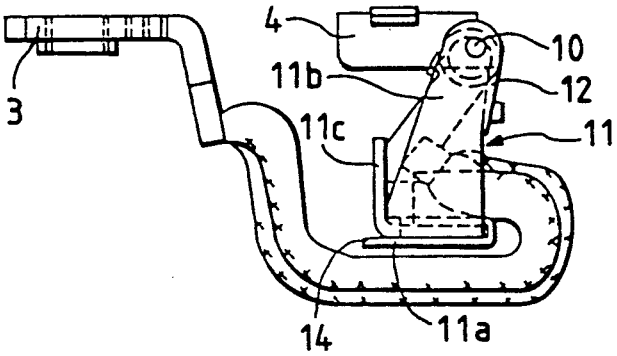
FIG. 18(B) PRIOR ART
FIG. 18(B) is a side view of FIG. 17.
Figure 19:
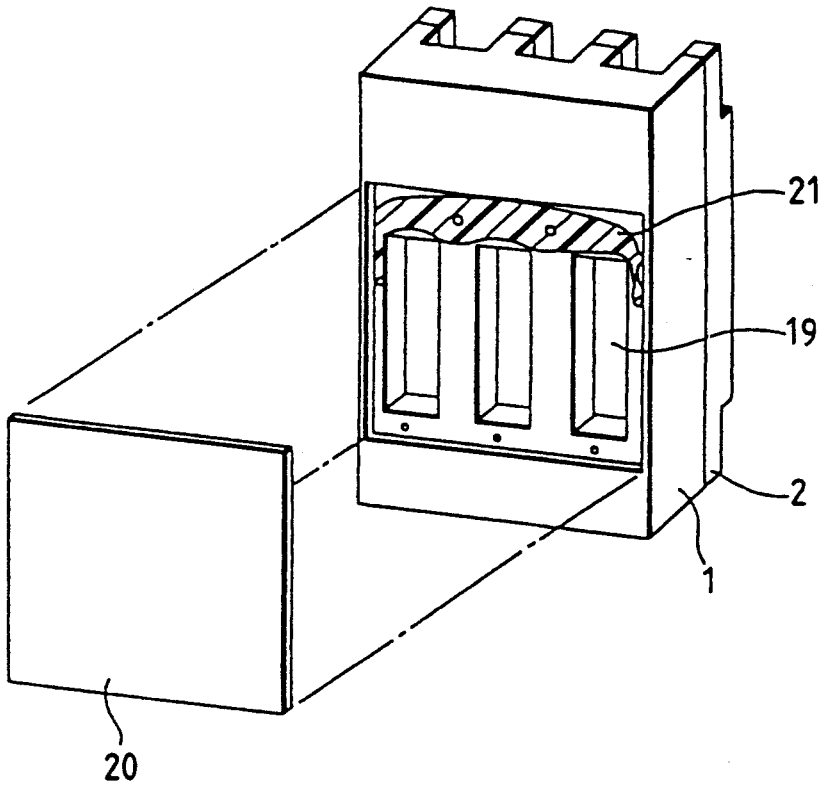
FIG. 19 PRIOR ART
FIG. 19 is an exploded perspective view illustrating the manner in which the rear cover is glued.

The packing 37 is molded from polyethylene and is formed with windows 38 which align with the openings of the spaces 19 in the housing 1. The packing 37 includes ribs 39 aligned with the windows 38. Further, the packing 37 is formed with grooves 39*a* on the other side of the ribs 39 as shown in FIG. 16(C). The packing 37 of the above-described construction is placed on the housing 1 as shown in FIG. 16(A) and is secured to the housing 1 by means of bolts inserted through the holes 20*a* in the rear cover 20 (FIG. 14) and holes 37*a* in the packing 37 as shown in FIG. 15. The operation and effects derived from this fifth embodiment are generally the same as those of the fourth embodiment. The packing 37 and the rear cover 20 are pressed harder against the housing 1, as compared to the fourth embodiment, with the aid of both the ribs 39 and grooves 39*a*, resulting in a reinforced hermetic sealing effect.

According to the invention, the terminal and the support angle for the second movable arm are integrally constructed as a unitary part. Thus, these parts can be easily assembled into a circuit breaker having a housing deeper than ordinary ones, saving assembly time and increasing assembly reliability. Installing the insulating cover on the support angle for isolating the rear cover or inserting the plate-like packing made of a resilient insulating material between the housing and the rear cover, eliminates the need for hermetically bonding the rear cover by using an adhesive, ensuring short assembly time and stable insulate effect.

Other embodiments of the invention will be apparent to those skilled in the art from consideration of the specification and practice of the invention disclosed herein. It is intended that the specification be considered exemplary only, with a true scope and spirit of the invention being indicated by the following claims.

We claim:

1. A circuit breaker, comprising:

a housing;

a terminal disposed in said housing;

a first movable arm disposed in said housing, including a first contact;

a support member disposed in said housing;

a second movable arm pivotally supported by said support member and being electrically connected to said terminal by a flexible lead, said second movable arm including a second contact and being disposed opposite said first movable arm so that said second contact contacts said first contact when a normal current flows, wherein said first movable arm exerts an electromagnetic repulsive force on said second arm in a direction where the first and second movable arm repel each other to open said first and second contacts in response to a current exceeding a predetermined value;

an insulating member fitted with said support member and said terminal to form a unitary construction, said insulating member insulating said support member from said terminal;

a rear cover disposed on said housing;

a plate-like packing disposed between said housing and said rear cover; and a chamber disposed in said housing, said chamber including an opening, said plate-like packing including a plurality of windows in alignment with said opening, wherein said rear cover is held tightly against said housing so that said chamber is hermetically isolated by said plate-like packing disposed between said rear cover and said housing.

2. The circuit breaker of claim 1, further comprising spring means for normally urging said second movable arm against said first movable arm so that said first contact engages said second contact.

3. The circuit breaker of claim 2, wherein said spring means is a return spring.

4. The circuit breaker of claim 1, further comprising a chamber disposed in said housing, and a current limiting resistor disposed in said chamber.

5. The circuit breaker of claim 1, further comprising an insulating cover connected to said terminal and disposed between said terminal and said rear cover.

6. The circuit breaker of claim 1, wherein said plate-like packing comprises a resilient insulating material.

7. The circuit breaker of claim 1, wherein said plate-like packing includes ribs disposed around said plurality of windows.

* * * * *